US009775453B2

(12) United States Patent
McNamara

(10) Patent No.: US 9,775,453 B2
(45) Date of Patent: Oct. 3, 2017

(54) TRAVEL MUG LID

(71) Applicant: Helen of Troy Limited, Belleville, St. Michael (BB)

(72) Inventor: Conor P. McNamara, Montclair, NJ (US)

(73) Assignee: Helen of Troy Limited, Belleville, St. Michael (BB)

( * ) Notice: Subject to any disclaimer, the term of this patent is extended or adjusted under 35 U.S.C. 154(b) by 71 days.

(21) Appl. No.: 14/646,128

(22) PCT Filed: Jan. 10, 2014

(86) PCT No.: PCT/US2014/011059
§ 371 (c)(1),
(2) Date: May 20, 2015

(87) PCT Pub. No.: WO2014/110381
PCT Pub. Date: Jul. 17, 2014

(65) Prior Publication Data

US 2015/0313386 A1 Nov. 5, 2015

Related U.S. Application Data

(60) Provisional application No. 61/751,491, filed on Jan. 11, 2013.

(51) Int. Cl.
*B65D 47/28* (2006.01)
*B65D 47/20* (2006.01)
(Continued)

(52) U.S. Cl.
CPC ..... *A47G 19/2205* (2013.01); *A47G 19/2272* (2013.01)

(58) Field of Classification Search
CPC .. A47G 19/2272; B65D 47/28; B65D 47/283; B65D 47/286; B65D 47/2037; B65D 47/2018; B65D 47/2031
(Continued)

(56) References Cited

U.S. PATENT DOCUMENTS 3,128,000 A * 4/1964 Haberle ..... B65D 47/2037 215/270
3,964,631 A 6/1976 Albert
(Continued)

FOREIGN PATENT DOCUMENTS

| | | |
|---|---|---|
| CN | 201178940 | 1/2009 |
| CN | 101828839 | 9/2010 |
| GB | 2219930 | 12/1989 |

OTHER PUBLICATIONS

International Search Report filed in PCT/US2014/011059 dated May 5, 2014.
(Continued)

*Primary Examiner* — Andrew T Kirsch
(74) *Attorney, Agent, or Firm* — Rankin, Hill & Clark LLP

(57) ABSTRACT

A travel mug lid includes a first lid member and a closing mechanism. The first lid member includes a button opening. The closing mechanism includes a button, a core and a flexible material connected with the core. The button moves with respect to the core. The button includes a terminal portion that extends through or into the button opening. The button moves at least a portion of the flexible material with respect to the first lid member to selectively prevent flow of liquid through the drinking passage. The button and the core are isolated from liquid in the cup at least partially by the flexible material.

14 Claims, 6 Drawing Sheets

(51) Int. Cl.
*A47G 19/22* (2006.01)
*B65D 51/12* (2006.01)

(58) Field of Classification Search
USPC ..... 220/305, 495.03, 715
See application file for complete search history.

(56) References Cited

U.S. PATENT DOCUMENTS

| | | | | | |
|---|---|---|---|---|---|
| 4,057,167 | A | | 11/1977 | Lee | |
| 4,094,433 | A | | 6/1978 | Numbers | |
| 4,099,642 | A | | 7/1978 | Nergard | |
| 4,212,408 | A | | 7/1980 | Valenzona | |
| 5,169,016 | A | * | 12/1992 | Hinz, Jr. ..... | B65D 47/2037 220/203.29 |
| 5,390,810 | A | | 2/1995 | Stroble et al. | |
| 6,354,459 | B1 | | 3/2002 | Hagihara | |
| 7,413,096 | B2 | | 8/2008 | Morgan et al. | |
| 7,416,093 | B2 | | 8/2008 | Lin et al. | |
| 7,546,933 | B2 | | 6/2009 | Pinelli | |

OTHER PUBLICATIONS

European Search Report filed in EP 14 73 8168 dated Aug. 1, 2017.

* cited by examiner

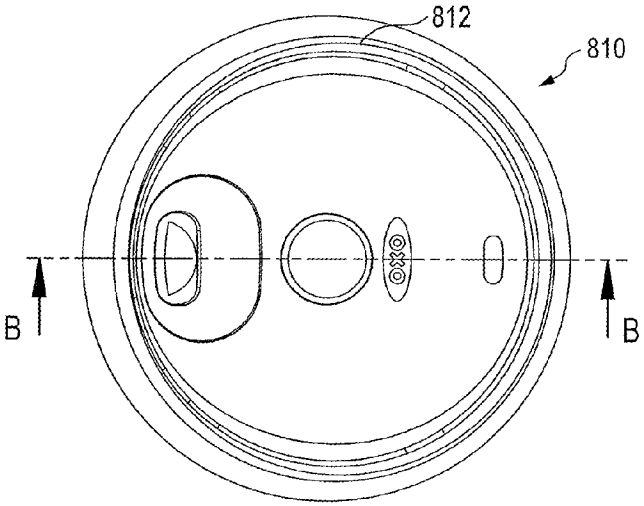
FIG. 14
FIG. 15
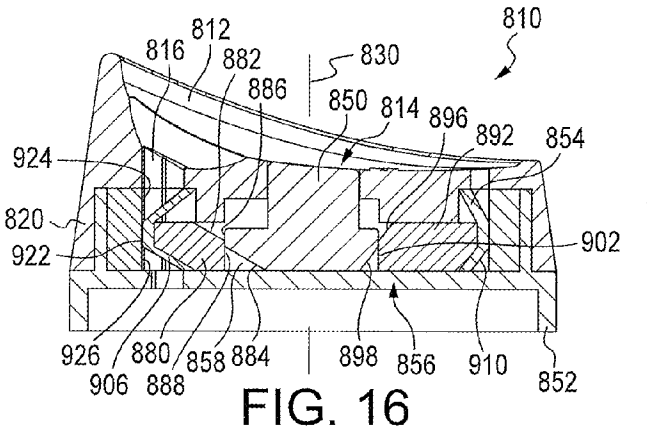
FIG. 16
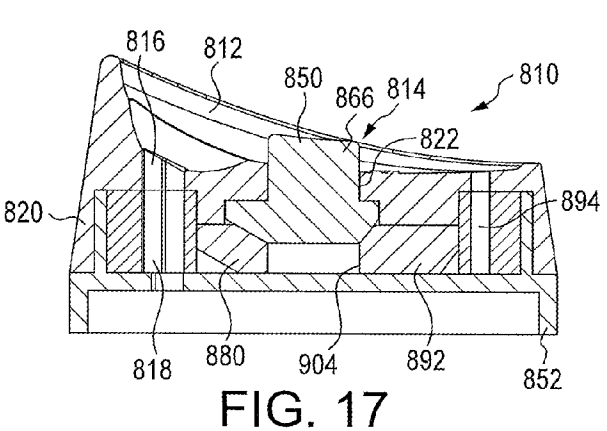
FIG. 17

TRAVEL MUG LID

BACKGROUND

Travel mug lids can include closing mechanisms to selectively close off a drinking passage. These closing mechanisms can be quite complicated and include many moving components. Problems arise when trying to clean these closing mechanisms.

SUMMARY

In view of the foregoing, travel mug lids are described that are each configured to engage an associated cup at an upper opening of the associated cup. Each travel mug lid described herein includes a closing mechanism having a flexible material, such as silicone. The flexible material can operate both as a valve closure and a seal to isolate moving components of the closing mechanism from liquid in the cup to which the lid is attached.

One example of a travel mug lid includes a first lid member and a closing mechanism attached with the first lid member for selectively preventing flow of liquid through a drinking passage provided through the lid. The first lid member defines a central axis and includes a button opening. The closing mechanism includes a button, a core and a flexible material connected with the core. The button moves with respect to the core. The button includes a terminal portion that extends through or into the button opening such that the terminal portion is accessible from an exterior of the first lid member when the lid is engaged with the associated cup. The core is made from a material that is more rigid than the flexible material. The button cooperates with the flexible material to move at least a portion of the flexible material with respect to the first lid member to selectively prevent flow of liquid through the drinking passage. The button and the core are isolated from liquid in the associated cup at least partially by the flexible material when the closing mechanism is connected with the first lid member and the lid is engaged with the associated cup.

In an alternative arrangement, a travel mug lid is described that is configured to engage an associated cup at an upper opening of the associated cup. The travel mug lid includes a first lid member and a closing mechanism attached with the first lid member for selectively preventing flow of liquid through a drinking passage provided through the lid. The first lid member defines a central axis and includes a button opening. The closing mechanism includes a button, a core and a flexible material connected with the core. The button moves with respect to the core. The button includes a terminal portion that extends through or into the button opening such that the terminal portion is accessible from an exterior of the first lid member when the lid is engaged with the associated cup. The core is made from a material that is more rigid than the flexible material. The button cooperates with the flexible material to move at least a portion of the flexible material with respect to the first lid member to selectively prevent flow of liquid through the drinking passage. The flexible material can include a movable section and a stationary section. The flexible material can also include a movable sealing edge. The actuation of the button can result in movement of the movable sealing edge with respect to a stationary sealing surface, and the movable sealing edge contacts the stationary sealing surface to close the drinking passage.

Aspects of each of the above discussed embodiments will be discussed below. Each aspect discussed below could be found in either embodiment.

The first lid member includes a side wall. The side wall of the first lid member can be cylindrical and vertically oriented. The side wall can include an upper section and a lower section having a diameter larger than the upper section. A shoulder is defined where an inner surface of the side wall transitions from the lower section to the upper section. The flexible material can press against the shoulder forming a liquid-tight seal between the flexible material and the first lid member.

The core of the closing mechanism can preclude movement of the button in a direction parallel to the central axis. The button can slide with respect to the core in a direction perpendicular to the central axis. In another embodiment, the button can slide with respect to the core in a direction perpendicular to the central axis, and also rotate about an axis, similar to a toggle switch. In another embodiment, the button can slide with respect to the core in a direction parallel to the central axis. The core can include an upper plate connected with a lower plate. A void can be defined between the upper plate and the lower plate. The button can be received in the void. The core can include a planar lower surface, and the flexible material can cover an entirety of the planar lower surface of the core. The core can include a substantially cylindrical peripheral side wall that follows a radius about the central axis but for where the button extends from the core toward the button opening.

The flexible material can cover a lower surface of the core around the substantially cylindrical peripheral side wall. The flexible material can be positioned so as to operate as a seal between the associated cup and the lid when the lid is engaged with the associated cup. The flexible material can also operate as a valve closure for the drinking passage. The flexible material can include a movable section and a stationary section. The movable section can be defined by at least one corrugation formed in the flexible material. The flexible material can include a movable sealing edge and a stationary sealing edge. Actuation of the button can result in movement of the movable sealing edge with respect to the stationary sealing edge. The stationary sealing edge can be diametrically opposed from the button opening. The flexible material can surround at least the majority of the exterior of the core and also envelope an outer end section of the button, which extends outwardly from the core. The flexible material can surround the terminal portion of the button.

The closing mechanism can include a follower operatively connected with the button. The follower can be biased for movement with respect to the button and be in contact with the flexible material. The flexible material can include a movable sealing edge and a stationary sealing edge, and actuation of the button can result in movement of the follower, which results in movement of the movable sealing edge with respect to the stationary sealing edge.

BRIEF DESCRIPTION OF THE DRAWINGS

FIG. 14 is a top plan view of another example of a travel mug lid in a closed position.

FIG. 15 is a top plan view of the travel mug lid shown in FIG. 14 in an open position.

FIG. 16 is a cross-sectional view taken along line A-A of FIG. 14.

FIG. 17 is a cross-sectional view taken along line B-B of FIG. 15.

DETAILED DESCRIPTION

Figure 1:
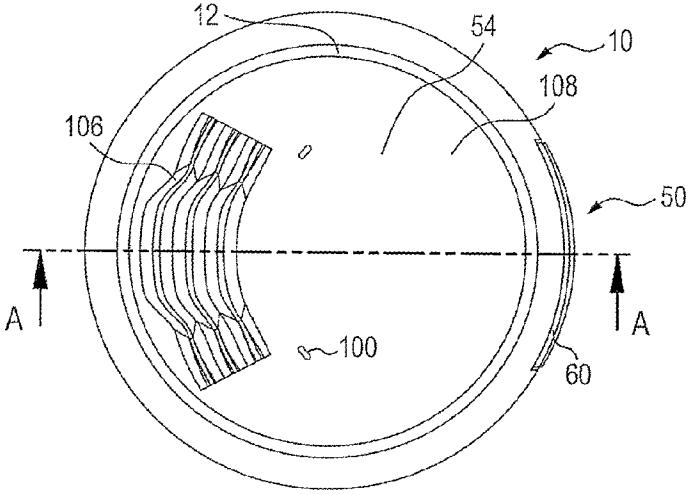
FIG. 1 is a top plan view of a travel mug lid in a closed position.

FIGS. 1-4 depict a travel mug lid 10 including a first lid member, which will be referred to as a rim 12, and a closing mechanism 14. The travel mug lid 10 fits onto a cup (not shown) to cover the upper opening of the cup to inhibit spilling of liquid held in the cup and to maintain the temperature of the liquid within the cup. The closing mechanism 14 isolates moving components so that these moving components are not directly exposed to liquid.

As illustrated, the rim 12 is generally annular in configuration. Although the rim 12 is shown as annular, the rim can take other configurations based on the shape of the cup to which the lid 10 is intended to attach. With reference back to the illustrated embodiment, the rim 12 includes an annular side wall 20. As illustrated, the side wall 20 is cylindrical and vertically oriented, and has an outer surface 22 and an inner surface 24. The inner surface 24 includes an upper section 26 and a lower section 28, which is offset from the upper section 26. The upper section 26 and a lower section 28 are each generally circular, or cylindrical, in configuration. The diameter of the lower section 28 measured perpendicular to a central axis 30 of the lid 10 is larger than the diameter of the upper section 26. As such, a shoulder 32 is defined where the inner surface 24 transitions from the lower section 28 to the upper section 26. The shoulder 32 is generally annular and centered with respect to the central axis 30.

The rim 12 also includes a button opening 40 formed in the side wall 28. The button opening 40 is located below the shoulder 32. The button opening 40 extends from the lower section 28 of the inner surface 24 outwardly through the side wall 20 of the rim 12 to the outer surface 22.

The rim 12 fits onto the upper edge of the cup (not shown). As illustrated, the upper edge of the cup (not shown) is received by the rim 12 and the outer surface of the cup engages the lower section 28 of the inner surface 24. The upper edge of the cup (not shown) seats against the closing mechanism 14. The rim 12, and more particularly the inner surface 24 thereof, defines a passage 42 which is circular in configuration when viewed normal to the central axis 30. The closing mechanism 14 cooperates with the rim 12 to selectively close off the passage 42.

Figure 2:
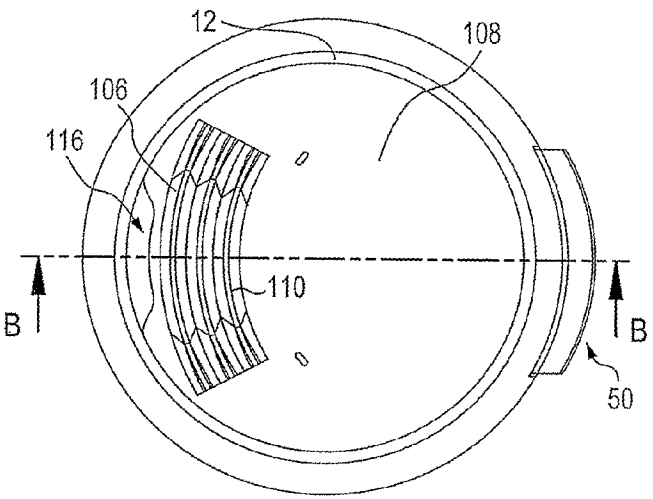
FIG. 2 is a top plan view of the travel mug lid shown in FIG. 1 in an open position.

The closing mechanism 14 includes a button 50, a core 52, and a flexible material 54. The button 50 moves, slides, or translates, in a direction perpendicular to the central axis 30 with respect to the core 52 and the rim 12. As illustrated, the button 50 slides parallel with the diameter of the rim 12, e.g., along lines A-A (FIG. 1) or B-B (FIG. 2). The button 50 cooperates with the flexible material 54 to selectively prevent the flow of liquid through the passage 42 in the rim 12.

The button 50 and the core 52 are isolated from liquid by the flexible material 54 when the closing mechanism 14 is connected with the rim 12 and the lid 10 is connected with the cup. The movable components of the closing mechanism 14, with the exception of the flexible material 54 itself, are isolated from liquid making cleaning of the lid 10 easier as compared to known lids having moving components exposed to liquid. When assembled, the flexible material 54 presses against the shoulder 32 formed in the rim 12 forming a liquid-tight seal between the flexible material 54 and the rim 12. An adhesive can also be applied between the flexible material 54 and the shoulder 32 to fix the closing mechanism within the rim 12. The upper edge of the cup (not shown) can press against the flexible material 54 sandwiching the closing mechanism 14 between the upper edge of the cup and the shoulder 32. The interface between the upper edge of the cup (not shown) and the flexible material 54 can form another liquid-tight seal.

In the illustrated embodiment, the button 50 is made from a rigid plastic material; however, the button can be made from other rigid materials. A terminal portion of the button 50 extends through or into the button opening 40. The button 50 includes a first end 60 that is exposed through the button opening 40. A second end 62 of the button 50 is opposite the first end 60 and the second end 62 is in contact with the flexible material 54. The button 50 includes a first section 64 that is received within the core 52 and a second section 66. The second section 66 extends from the core 52 away from the button opening 40 toward a section of the rim 12 diametrically opposed from the button opening. The first section 64 terminates in the first end 60 and the second section 66 terminates in the second end 62. In the illustrated embodiment, the second end 66 is thinner than the first end 64 in a direction measured parallel to the central axis 30. The length of button 50 as measured perpendicular to the central axis 30 is longer than the inner diameter of the rim 12 at the lower section 28 of the inner surface 24. The button 50 also includes a lower surface 68 and an upper surface 70. Each of these surfaces 68, 70 can be generally planar.

The core 52 in the illustrated embodiment is also made from a rigid plastic material; however, other rigid materials could be utilized. The core 52 operates to fix the movement of the button 50 to preclude movement of the button in a direction parallel to the central axis 30. In the illustrated embodiment, the core 52 precludes movement of the button 50 in directions other than along the diameter of the rim 12, e.g., along lines A-A (FIG. 1) or B-B (FIG. 2). The core 52 includes an upper plate 80 connected with a lower plate 82 by internal side walls 84 (only one which is visible in FIGS. 3 and 4). A void 86 is defined between the upper plate 80, the lower plate 82 and the side walls 84. The first section 64 of the button 50 is received within this void 86. The core 52 also includes a substantially cylindrical peripheral side wall 88 that substantially surrounds the central axis 30 but for where the button 50 extends from the core 52 toward the button opening 40. The peripheral side wall 88 includes an external side surface 92 and an internal side surface 94. The peripheral side wall 88 follows a radius about the central axis 30 that is slightly smaller than the radius of the lower section 28 of the inner surface 24 of the rim 12. The external side surface 92 is surrounded by the flexible material 54, which contacts the lower section 28 of the internal surface 24 of the rim 12 forming a liquid-tight seal there between. The core 52 also includes an upper surface 96 and a lower surface 98, each of which can be planar.

The flexible material 54 in the illustrated embodiment is silicone. Other flexible materials could be utilized; however, it is desirable to have a flexible material 54 be more flexible than the material from which the button 50 and the core 52 are made. It is also desirable that the flexible material 54 be able to maintain a fluid-tight seal where the flexible material contacts the inner surface 24 of the rim 12 and the upper surface of the cup (not shown). The flexible material 54 substantially encapsulates the core 52 and the button 50 and covers the passage 42 through the rim 12 but for small ventilation openings 100 formed through the flexible material when the closing mechanism is in the closed position (such as shown in FIG. 1). The flexible material 54 contacts and covers the lower surface 98 of the core 52, and can also contact and/or cover the lower surface 68 of the button 50. The flexible material 54 covers the lower surface 68, the second end 62 and the upper surface 70 of the button 50 and the upper surface 96 of the core 52. By covering the lower surface 98 of the core 52 near the button opening 40 and the lower surface of the core 52 around the cylindrical side wall 88, the flexible material 54 can operate as a fluid-tight seal between the travel mug lid 10 and the upper edge of the cup (not shown) to which the lid 10 attaches. As such, the flexible material 54 can operate both as a seal between the cup (not shown) and the lid 10 and a valve closure for the passage 42 through the lid 12.

The flexible material 54 includes a movable section 106 and a stationary section 108. In the illustrated embodiment, the movable section 106 is defined by a plurality of corrugations 110 formed in the flexible material 54. The corrugations 110 are curved. The corrugations 110 are formed, and the movable section 106 is located, in the flexible material 54 where the flexible material surrounds the second section 66 of the button 50.

Figure 3:
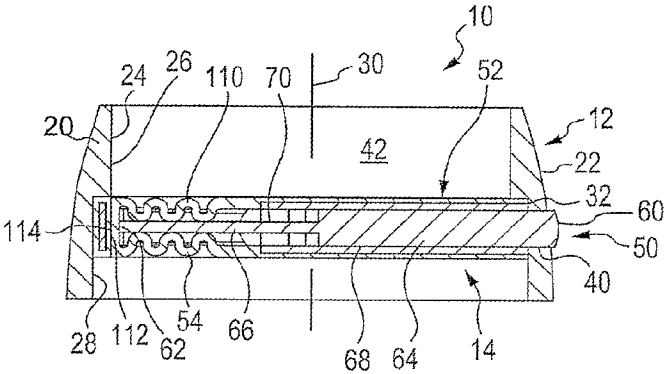
FIG. 3 is a cross-sectional view taken along line A-A of FIG. 1.

The button 50 is slidable in a direction perpendicular to the central axis 30. In a closed position, such as shown in FIGS. 1 and 3, the button 50 is positioned such that the second end 62 of the button 50 presses a movable sealing edge 112 of the flexible material 54 in contact with a stationary sealing edge 114 of the flexible material 54. The stationary sealing edge 114 of the flexible material 54 is diametrically opposed from the button opening 40. In the closed position shown in FIGS. 1 and 3, liquid from the cup is precluded from traveling through the passage 42 formed by the rim 12.

Figure 4:
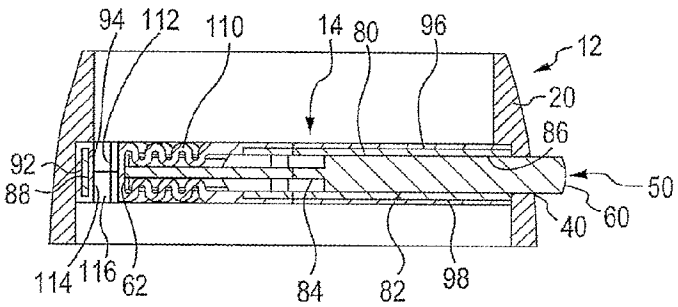
FIG. 4 is a cross-sectional view taken along line B-B of FIG. 2.

In the position shown in FIGS. 2 and 4, the movable sealing edge 112 of the flexible material 54 has moved to the right from the closed position shown in FIGS. 1 and 3. The flexible material 54 surrounding the second end 62 of the button 50, i.e., the portion of the flexible material defining the movable sealing edge 112, is spaced from the flexible material 54 that surrounds the cylindrical side wall 88 at the section diametrically opposed from the first end 60 of the button 50, i.e., the stationary sealing edge 114 of the flexible material 54. As such, a drinking passage 116 is formed between the movable sealing edge 112 and the stationary sealing edge 114 of the flexible material 54. The flexible material 54 in the illustrated embodiment is an integrally formed (e.g., one-piece unit) that includes the movable section 106, the stationary section 108, the corrugations 110, the movable sealing edge 112, and the stationary sealing edge 114 all interconnected with one another.

A cam follower mechanism can be provided with the closing mechanism. The cam follower mechanism can include a spring that biases the button 60 toward the open position shown in FIGS. 2 and 4. By utilizing such a cam follower mechanism, an operator can press the button inwardly when the button is in the closed position and the biasing mechanism can move the button toward the open position. Alternatively, when the button is in the open position, the operator can press the button inwardly and overcome the biasing force of the spring whereby the cam follower mechanism locks the button in the closed position shown in FIGS. 1 and 3. The cam follower mechanism can also be located in the void 86 in the core 52, and thus be isolated from the liquid in the cup and traveling through the drinking passage 116.

Figure 5:
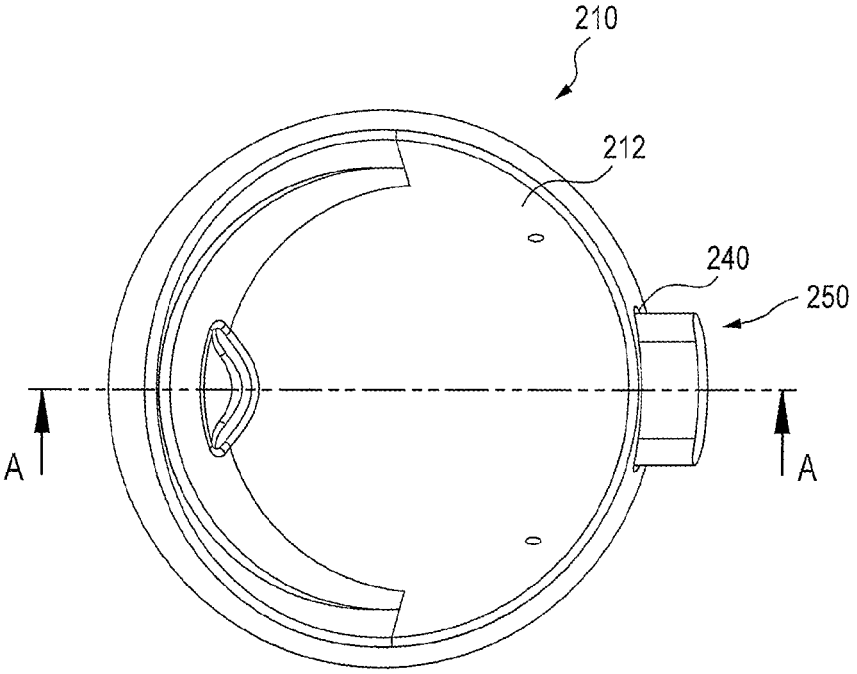
FIG. 5 is a top plan view of an alternative embodiment of a travel mug lid.
Figure 6:
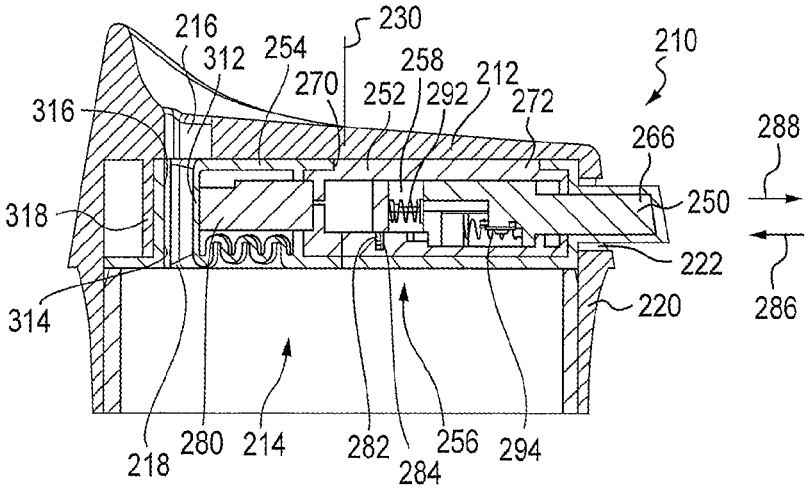
FIG. 6 is a cross-sectional view taken along line A-A of FIG. 5.
Figure 7:
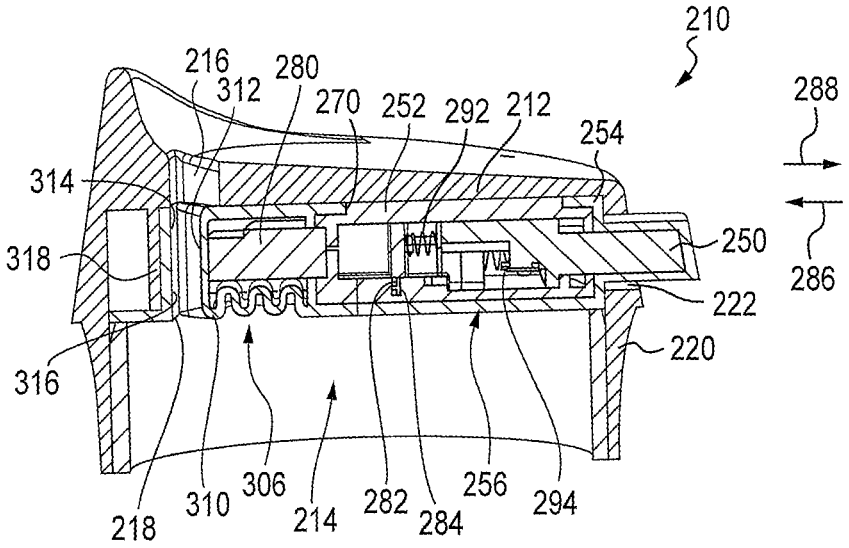
FIG. 7 is a perspective of the cross-sectional view shown in FIG. 6.

FIGS. 5-7 depict an alternative travel mug lid 210 that is similar to the travel mug lid 10 described above. The travel mug lid 210 fits onto a cup (not shown) to cover the upper opening of the cup to inhibit spilling of liquid held in the cup and to maintain the temperature of the liquid within the cup. The differences between the travel mug lid 210 and the travel mug lid 10 described above will be described in detail, and where the lids are similar in configuration further description will not be provided for the sake of brevity.

The travel mug lid 210 includes a first lid member, which will be referred to as a cover 212, and a closing mechanism 214. The cover 212 is similar to the rim 12 described above, with the exception that the cover includes top section having an opening 216 that at least partially defines a drinking passage 218 through which liquid exits the cup. The cover 212 includes a side wall 220 and defines a central axis 230. The travel mug lid 210 includes a button opening 222 in the side wall 220. The closing mechanism 214 isolates moving components of the mechanism so that these moving components are not directly exposed to liquid.

The closing mechanism 214 includes a button 250, a rigid core 252, flexible material 254, and a click-click (cam follower) mechanism 256. The button 250 translates in a direction generally perpendicular to the central axis 230 of the lid 210. The core 252 includes a void 258 in which many of the moving components of the closing mechanism 214 are disposed. The flexible material 254 surrounds at least a majority of the exterior of the core 252, and in the embodiment illustrated in FIGS. 5-7 the flexible material also envelops a terminal portion 266 of the button 250. The terminal portion 266 is the section of the button 250 that extends outwardly from the button opening 222 formed in a side wall 220 of the cover 212. The flexible material 254 that surrounds the terminal portion 266 of the button 250 can be connected with and/or in contact with the rigid core 252, or a separate piece of flexible material can connect with the side wall 220 of the cover 212 and cover the button opening 222 to encapsulate and/or envelop the terminal portion 266 of the button 250.

As illustrated in FIGS. 6 and 7, the flexible material 254, which can be a silicone material such as that described above, includes an opening 270. The opening 270 allows for the insertion of the movable components of the closing mechanism 214 into an internal area defined by the flexible material. The core 252 can include a raised boss 272 against which the flexible material seals when the core is inserted into the flexible material through the opening. As such, a watertight seal can be formed between the flexible material 254 and the core 252 around the opening 270 in the flexible material against the raised boss 272.

The closing mechanism 214 is shown in the open position in FIGS. 6 and 7. To close the drinking passage 242, an operator pushes the button 250 inwardly toward the interior of the cup and toward the drinking passage 242.

The click-click mechanism 256 includes a follower 280 having a sliding pin 282 positioned in a track 284. Movement of the button 250 in the direction of arrow 286 moves the follower 280 in the same direction and results in the pin 282 moving within the track 284. The follower 280 is biased in a direction of arrow 288, and as such, when the pin 282 moves along the track 284 to a resting area, the follower 280 moves slightly in the direction of arrow 288 but the drinking passage 218 is still closed by the flexible material 254 and the follower 280. To open the closing mechanism, the operator again pushes the button 250 in the direction of arrow 286, which results in the pin 282 moving away from the resting position and the biasing force of springs 292 and 294 can bias the button 250 and the follower 280 in the direction of arrow 288, thus opening the drinking passage 218.

The flexible material 254 includes a movable section 306 and a stationary section 308, which does not move with respect to the core 252 and the cover 212. In the illustrated embodiment, the movable section 306 is defined by a plurality of corrugations 310 formed in the flexible material 254. The corrugations 310 are curved. The corrugations 310 are formed, and the movable section 306 is located, in the flexible material 254 where the flexible material surrounds the follower 280.

In a closed position, a movable sealing edge 312 of the flexible material 254 contacts a stationary sealing surface 314, which can be a stationary sealing edge 316 made of the flexible material 254. The stationary sealing surface 314 could also be an internal surface of the side wall 220. The stationary sealing edge 316 of the flexible material 254 is diametrically opposed from the button opening 222. In the closed position, liquid from the cup is precluded from traveling through the drinking passage 218.

When in the open position, the flexible material 254 surrounding the follower 280, which includes a portion of the flexible material defining the movable sealing edge 312, is spaced from the flexible material 254 that surrounds a cylindrical peripheral side wall 318 at the stationary sealing edge 316 of the flexible material 254. As such, the drinking passage 218 is formed between the movable sealing edge 312 and the stationary sealing edge 316 of the flexible material 254. The flexible material 254 in the illustrated embodiment is an integrally formed (e.g., one-piece unit) that includes the movable section 306, the stationary section 308, the corrugations 310, the movable sealing edge 312, and the stationary sealing edge 316 all interconnected with one another.

Figure 8:
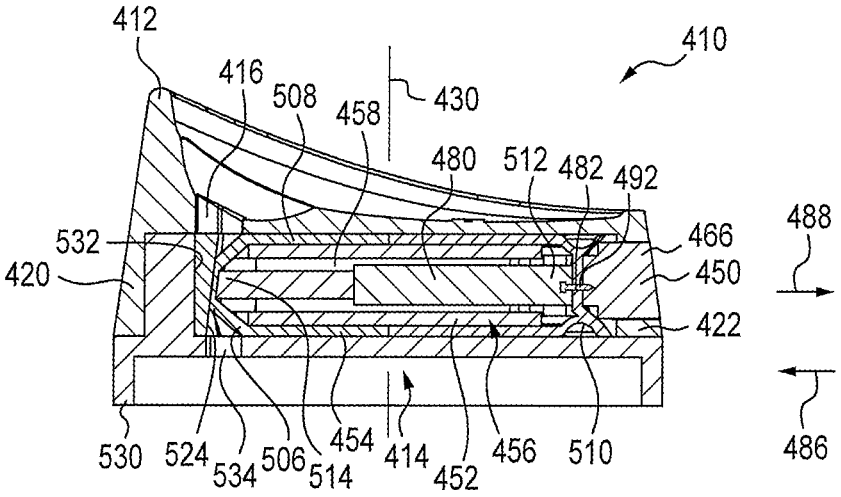
FIG. 8 is a cross-sectional view taken along a line in a similar location as line A-A of FIG. 5 of another embodiment of a travel mug lid in a closed position.
Figure 9:
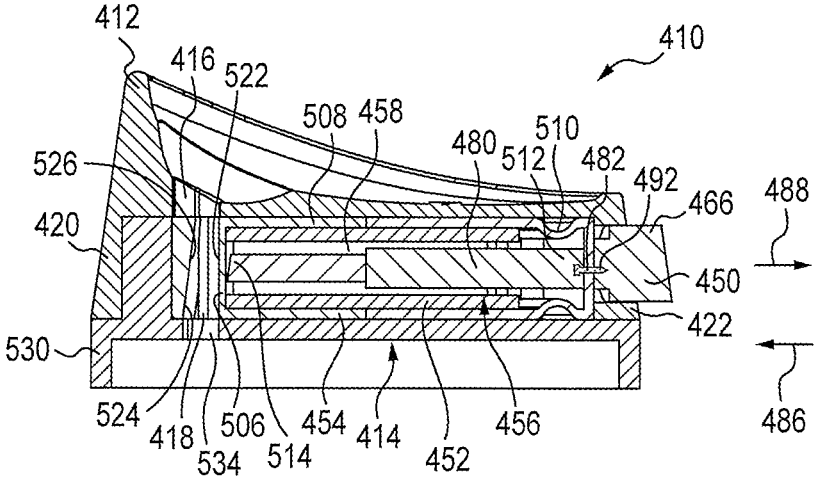
FIG. 9 is a cross-sectional view of the travel mug lid shown in FIG. 8, but in the open position.

FIGS. 8 and 9 depict an alternative travel mug lid 410 that is similar to the travel mug lids 10, 210 described above. The travel mug lid 410 fits onto a cup (not shown) to cover the upper opening of the cup to inhibit spilling of liquid held in the cup and to maintain the temperature of the liquid within the cup. The differences between the travel mug lid 410 and the travel mug lids 10, 210 described above will be described in detail, and where the lids are similar in configuration further description will not be provided for the sake of brevity.

The travel mug lid 410 includes a first lid member, which will also be referred to as a cover 412, and a closing mechanism 414. The cover 412 is similar to the cover 212 described above having an opening 416 that at least partially defines a drinking passage 418 through which liquid exits the cup. The cover 412 includes a side wall 420 and defines a central axis 430. The travel mug lid 410 includes a button opening 422 in the side wall 420. The closing mechanism 414 isolates moving components of the mechanism so that these moving components are not directly exposed to liquid.

The closing mechanism 414 includes a button 450, a rigid core 452, flexible material 454, and a click-click (cam follower) mechanism 456, which is only depicted schematically in FIGS. 8 and 9. The button 450 translates in a direction generally perpendicular to a central axis 430 of the lid 410. The core 452 includes a void 458 in which many of the moving components of the closing mechanism 414 are disposed. The flexible material 454 surrounds at least a majority of the exterior of the core 452. In the embodiment illustrated in FIGS. 8 and 9, the flexible material 454 surrounds the core 452, but not the button 450. The flexible material 454 can be silicone.

The closing mechanism 414 is shown in the open position in FIG. 9 and in the closed position in FIG. 8. To close the drinking passage 418, an operator pushes the button 450 inwardly toward the interior of the cup and toward the drinking passage 418. A terminal portion 466 of the button 450 extends through the button opening 422 so as to be accessible by an operator.

The click-click mechanism 456 includes a follower 480 connected with the button 450 by a fastener 482. Other manners to connect the button 450 with the follower 480 so that the button moves along with the fastener, and vice versa, can be employed. The click-click mechanism 456 can operate similar to the click-click mechanism 256 described above. Movement of the button 450 in the direction of arrow 486 moves the follower 480 in the same direction. The follower 480 is biased in a direction of arrow 488, and as such, when the follower 480 is not retained in the closed position (shown in FIG. 8) the follower 480 is urged toward the open position (shown in FIG. 9).

The button 450 is not surrounded by the flexible material 454 in this embodiment. The button 450 is connected with the follower 480 by the fastener 482, which extends through an opening 492 in the flexible material 454, but the flexible material 454 seals against the fastener 482 to prevent the ingress of water into the void 458 defined by the core 452. The flexible material 454 includes a movable section (two movable sections 506, 510 will be described) and a stationary section 508, which does not move with respect to the core 452 and the cover 412. In the illustrated embodiment, there is a forward movable section 506 disposed adjacent the drinking passage 418 and a rear movable section 510 disposed adjacent the button 450. The button 450 and a proximal end 512 of the follower 480 are in contact with the rear movable section 510. A distal end 514 of the follower 480 is in contact with the forward movable section 506. The movable sections 506, 510 allow for the button 450 and the follower 480 to move so that the closing mechanism can move between an open and closed position.

In a closed position, a movable sealing edge 522 of the flexible material 454 contacts a stationary sealing surface 524, which can be a stationary sealing edge 526 made of the flexible material 454. The stationary sealing surface 524 could also be an internal surface of the side wall 420, or an internal surface of an insert 530, which will be described below. The stationary sealing edge 526 of the flexible material 454 is diametrically opposed from the button opening 422. In the closed position, liquid from the cup is precluded from traveling through the drinking passage 418.

When in the open position, the flexible material 454 surrounding the distal end 514 follower 480, which includes a portion of the flexible material defining the movable sealing edge 522, is spaced from flexible material 454 that contacts an inner surface 532 of the insert 530 adjacent the drinking passage 418. As such, the drinking passage 418 is formed between the movable sealing edge 522 and the stationary sealing edge 526 of the flexible material 454. The insert 530 connects with the cover 412 to fix the closing mechanism to the cover. The insert 530 also includes an opening 534 which aligns with the opening 416 in the cover 412 to at least partially define the drinking passage 418.

FIGS. 10-13 depict an alternative travel mug lid 610 that is similar to the travel mug lids 10, 210, 410 described above. The travel mug lid 610 fits onto a cup (not shown) to cover the upper opening of the cup to inhibit spilling of liquid held in the cup and to maintain the temperature of the liquid within the cup. The travel mug lid 610 includes a first lid member, which will also be referred to as a cover 612, and a closing mechanism 614. The cover 612 includes an opening 616 that at least partially defines a drinking passage 618 through which liquid exits the cup. The cover 612 includes a side wall 620 and defines a central axis 630. The travel mug lid 610 includes a button opening 622 in the side wall 620. The closing mechanism 614 isolates moving components of the mechanism so that these moving components are not directly exposed to liquid.

The closing mechanism 614 includes a button 650, which in this embodiment is a toggle switch, a rigid core 652, flexible material 654, and a follower mechanism 656. The button 650 translates in a direction generally perpendicular to a central axis 630 of the lid 610, and the button 650 also rotates about a pin 660. The core 652 includes a void 658 in which many of the moving components of the closing mechanism 614 are disposed. In the embodiment illustrated in FIGS. 10-13, the flexible material 654 surrounds the core 652, but not the button 650. The flexible material 654 can be silicone.

Figure 11:
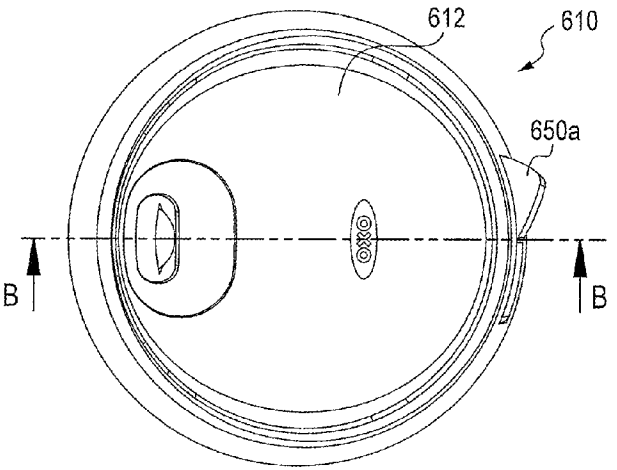
FIG. 11 is a top plan view of the travel mug lid shown in FIG. 10 in an open position.
Figure 10:
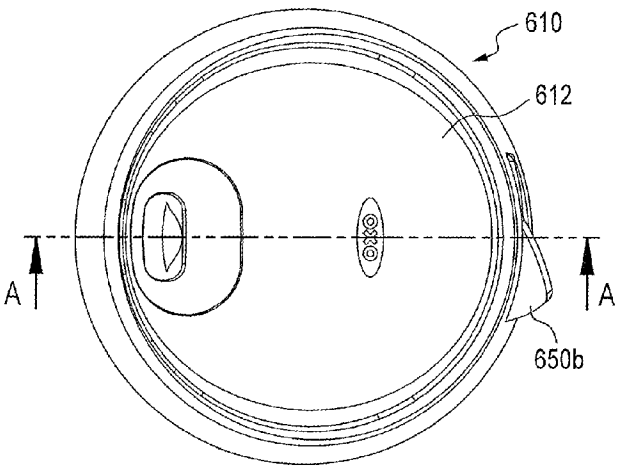
FIG. 10 is a top plan view of another example of a travel mug lid in a closed position.
Figure 13:
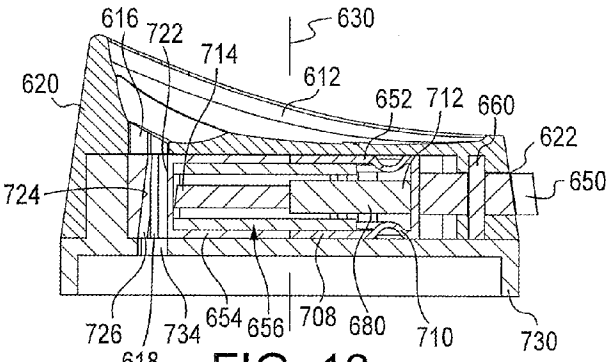
FIG. 13 is a cross-sectional view taken along line B-B of FIG. 11.
Figure 12:
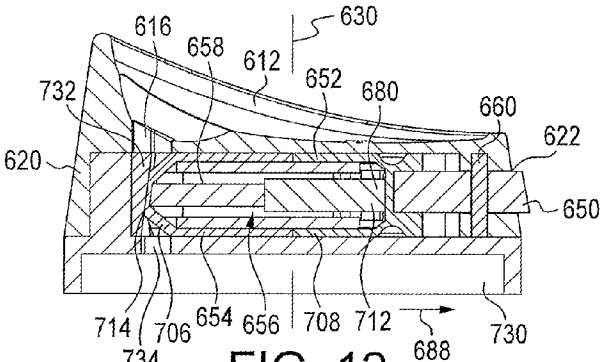
FIG. 12 is a cross-sectional view taken along line A-A of FIG. 10.

The closing mechanism 614 is shown in the open position in FIGS. 11 and 13. The closing mechanism 614 is shown in the closed position in FIGS. 10 and 12. To close the drinking passage 618, an operator pushes a first section 650*a* of the button 650 inwardly toward the interior of the cup and toward the drinking passage 618. When the closing mechanism 614 is in the open position, this first section 650*a* of the button 650 extends through the button opening 622 so as to be accessible by an operator. To open the drinking passage 618, an operator pushes a second section 650*b* of the button 650 inwardly toward the interior of the cup and toward the drinking passage 618. When the closing mechanism 614 is in the closed position, this second section 650*b* of the button 650 extends through the button opening 622 so as to be accessible by an operator.

The follower mechanism 656 includes a follower 680 operatively connected with the button 650 such that movement of the first section 650*a* of the button 650 moves the follower 680 in the same direction. The follower 680 can be biased in a direction of arrow 688, and as such, when the follower 680 or the button 650 is not retained in the closed position (shown in FIGS. 10 and 12) the follower 680 is urged toward the open position (shown in FIGS. 9 and 11). The button 650 and/or the follower 680 can include catches that can cooperate with detents (for example) on the core 652 or the cover 612 to retain the position of the button and/or the follower against a biasing force. The force provided by the operator on either section 650*a*, 650*b* of the button can overcome the catch/detent mechanism to allow for movement of the button and the follower 680.

The button 650 is not surrounded by the flexible material 654 in this embodiment. The button 650 contacts the flexible material 654, which is in contact with the follower 680. The flexible material 654 includes a movable section (two movable sections 706, 710 will be described) and a stationary section 708. In the illustrated embodiment, there is a forward movable section 706 disposed adjacent the drinking passage 618 and a rear movable section 710 disposed adjacent the button 650. The button 650 and a proximal end 712 of the follower 680 are in contact with the rear movable section 710 such that the flexible material 654 is sandwiched between the proximal end 712 and the button 650. A distal end 714 of the follower 680 is in contact with the forward movable section 706. The movable sections 706, 710 allow for the button 650 and the follower 680 to move so that the closing mechanism 614 can move between an open and closed position.

In a closed position, a movable sealing edge 722 of the flexible material 654 contacts a stationary sealing surface 724, which can be a stationary sealing edge 726 made of the flexible material 654. The stationary sealing surface 724 could also be an internal surface of the side wall 620, or an internal surface of an insert 730, which will be described below. The stationary sealing edge 726 of the flexible material 654 is diametrically opposed from the button opening 622. In the closed position, liquid from the cup is precluded from traveling through the drinking passage 618.

When in the open position, the flexible material 654 surrounding the distal end 714 follower 680, which includes a portion of the flexible material defining the movable sealing edge 722, is spaced from flexible material 654 that contacts an inner surface 732 of the insert 730 adjacent the drinking passage 618. As such, the drinking passage 618 is formed between the movable sealing edge 722 and the stationary sealing edge 726 of the flexible material 654. The insert 730 connects with the cover 612 to fix the closing mechanism 614 to the cover. The insert 730 also includes an opening 734 which aligns with the opening 616 in the cover 612 to at least partially define the drinking passage 618.

FIGS. 14-17 depict an alternative travel mug lid 810 that is similar to the travel mug lids 10, 210, 410, 610 described above. The travel mug lid 810 fits onto a cup (not shown) to cover the upper opening of the cup to inhibit spilling of liquid held in the cup and to maintain the temperature of the liquid within the cup. The travel mug lid 810 includes a first lid member, which will also be referred to as a cover 812, and a closing mechanism 814. The cover 812 includes an opening 816 that at least partially defines a drinking passage 818 through which liquid exits the cup. The cover 812 includes a side wall 820 and defines a central axis 830. The cover 812 includes a button opening 822, which different from previous embodiments is not located in the side wall 820. The closing mechanism 814 isolates moving components of the mechanism with a flexible material 854 (which can be silicone) so that these moving components are not directly exposed to liquid in the cup.

The closing mechanism 814 includes a button 850, a rigid core 852, which can be similar to the insert 530, 730 described above, the flexible material 854, and a follower mechanism 856. In the embodiment depicted in FIGS. 14-17, the button 850 translates in a direction generally parallel to the central axis 830 of the lid 810. The core 852 and the cover 812 define a void 858 in which many of the moving components of the closing mechanism 814 are disposed. In the embodiment illustrated in FIGS. 14-17, the flexible material 854 is cylindrical and surrounds the core 852. The flexible material 854 attaches to the lower surface of the cover 812 and the upper surface of the core 852 in the illustrated embodiment. In an alternative arrangement the flexible material 854 could surround the closing mechanism but for an opening to receive the button 852.

The closing mechanism 814 is shown in the open position in FIGS. 15 and 17. The closing mechanism 814 is shown in the closed position in FIGS. 14 and 16. To open and to close the drinking passage 818, an operator pushes a terminal portion 866 of the button 850 downward (per the orientation of the drawings) or inwardly toward the interior of the cup. The terminal portion 866 extends through or into the button opening 822 such that the terminal portion is accessible from an exterior of the cover 812 when the lid 810 is engaged with the cup.

The follower mechanism 856 includes a drinking passage follower 880 operatively connected with the button 850 such that movement of the button 850 moves the drinking passage follower 880. The drinking passage follower 880 includes an angled face 882 and the button 850 includes a cooperating angled surface 884. Although not particularly shown in the drawings, the button 850 can operate similar to a ball point pen or cam follower mechanism between a locked "up" position shown in FIG. 17 and a locked "down" position shown in FIG. 16. Movement of the button 850 from the "up" position shown in FIG. 16 results in movement of the drinking passage follower 880 to the left (per the orientation of FIG. 16). When the closing mechanism 814 is in the closed position (FIG. 16), a catch surface 886, which is vertical in FIG. 16, of the button 850 engages a catch face 888, which is also vertical, on the drinking passage follower 880.

The follower mechanism 856 in FIGS. 14-17 also includes a vent passage follower 892. The vent passage follower 892 moves to open and to close a vent passage 894 formed through the lid 810. The vent passage follower 892 includes an angled face 896 and the button 850 includes a cooperating angled surface 898. Movement of the button 850 from the "up" position shown in FIG. 16 results in movement of the vent passage follower 892 to the right (per the orientation of FIG. 16). When the closing mechanism 814 is in the closed position (FIG. 16), a catch surface 902, which is vertical in FIG. 16, of the button 850 engages a catch face 904, which is also vertical, on the vent passage follower 892.

The flexible material 854 is in contact with the drinking passage follower 880 and the vent passage follower 892. The flexible material 854 includes a movable section 906 that operates as a valve closure for the drinking passage 818 and the vent passage 894 while operating as a seal to isolate the followers 880 and 892 from the liquid in the cup. In the illustrated embodiment, there is a forward movable section 906 disposed adjacent the drinking passage 818 and a rear movable section 910 disposed adjacent the vent passage 894.

In the closed position, a movable sealing edge 922 of the flexible material 854 contacts a stationary sealing surface 824, which can be a stationary sealing edge 926 made of the flexible material 854 to close off the drinking passage 818. The stationary sealing surface 924 could also be an internal surface of the side wall 820, or an internal surface of the core 852. The closing of the vent passage 894 is very similar, and therefore, will not be described with particularity. The stationary sealing edge 926 of the flexible material 854 in the drinking passage 818 is diametrically opposed from the vent passage 894. In the closed position, liquid from the cup is precluded from traveling through the drinking passage 818 and the vent passage 894.

Travel mug lids have been described above with particularity. Each of the travel mug lids includes flexible material, which can be silicone, that can be flexed or moved with respect to a more rigid component and operate as a valve closure and a seal for sealing moving components from liquid in the cup to which the lid is attached. Modifications and alternations will occur to those upon reading and understanding the preceding detailed description. Moreover, aspects from one embodiment can be employed in other embodiments. The invention is not limited to only the embodiments described above. Instead, the invention is defined by the following claims and the equivalents thereof.

The invention claimed is:

1. A travel mug lid configured to engage an associated cup at an upper opening of the associated cup, the lid comprising:

a first lid member defining a central axis and including a button opening; and a closing mechanism attached with the first lid member for selectively preventing flow of liquid through a drinking passage provided through the lid and at least partially defined by the first lid member, the closing mechanism including a button, a core that is separate from the first lid member and a flexible material connected with the core, wherein the button moves with respect to the core, wherein the button includes a terminal portion that extends through or into the button opening such that the terminal portion is accessible from an exterior of the first lid member when the lid is engaged with the associated cup, wherein the core is made from a material that is more rigid than the flexible material, wherein the button cooperates with the flexible material to move at least a portion of the flexible material with respect to the first lid member to selectively prevent flow of liquid through the drinking passage, and wherein the button and the core are isolated from liquid in the associated cup at least partially by the flexible material when the closing mechanism is connected with the first lid member and the lid is engaged with the associated cup.

2. The lid of claim 1, wherein the core precludes movement of the button in a direction parallel to the central axis and the button slides with respect to the core in a direction perpendicular to the central axis.

3. The lid of claim 1, wherein the core includes an upper plate connected with a lower plate, wherein a void is defined between the upper plate and the lower plate, and the button is received in the void.

4. The lid of claim 1, wherein the core includes a planar lower surface, wherein the flexible material covers an entirety of the planar lower surface of the core.

5. The lid of claim 1, wherein the core includes a substantially cylindrical peripheral side wall that follows a radius about the central axis but for where the button extends from the core toward the button opening, wherein the flexible material covers a lower surface of the core around the substantially cylindrical peripheral side wall.

6. The lid of claim 1, wherein the flexible material includes a movable section and a stationary section.

7. The lid of claim 6, wherein the flexible material is positioned so as to operate as a seal between the associated cup and the lid when the lid is engaged with the associated cup, and the flexible material operates as a valve closure for the drinking passage.

8. The lid of claim 6, wherein the movable section is defined by at least one corrugation formed in the flexible material.

9. The lid of claim 6, wherein the flexible material includes a movable sealing edge and a stationary sealing edge, wherein actuation of the button results in movement of the movable sealing edge with respect to the stationary sealing edge.

10. The lid of claim 9, wherein the stationary sealing edge is diametrically opposed from the button opening.

11. The lid of claim 9, wherein the flexible material surrounds at least a majority of the exterior of the core, and also envelops an outer end section of the button, which extends outwardly from the core.

12. The lid of claim 1, wherein the flexible material surrounds the terminal portion of the button.

13. The lid of claim 1, wherein the closing mechanism includes a follower operatively connected with the button, the follower is biased for movement with respect to the button and is in contact with the flexible material, wherein the flexible material includes a movable sealing edge and a stationary sealing edge, wherein actuation of the button results in movement of the follower, which results in movement of the movable sealing edge with respect to the stationary sealing edge.

14. A travel mug lid configured to engage an associated cup at an upper opening of the associated cup, the lid comprising:

a first lid member defining a central axis and including a button opening; and a closing mechanism attached with the first lid member for selectively preventing flow of liquid through a drinking passage provided through the lid and at least partially defined by the first lid member, the closing mechanism including a button configured to be pressed by an operator, a core and a flexible material connected with the core, wherein the button moves with respect to the core, wherein the button includes a terminal portion that extends through or into the button opening such that the terminal portion is accessible from an exterior of the first lid member when the lid is engaged with the associated cup, wherein the core is made from a material that is more rigid than the flexible material, wherein the button cooperates with the flexible material to move at least a portion of the flexible material with respect to the first lid member to selectively prevent flow of liquid through the drinking passage, wherein the flexible material includes a movable section and a stationary section, and wherein the flexible material includes a movable sealing edge, wherein actuation of the button results in movement of the movable sealing edge with respect to a stationary sealing surface, and the movable sealing edge contacts the stationary sealing surface to close the drinking passage, and wherein the flexible material surrounds the terminal portion of the button.

* * * * *